United States Patent [19]

Landis et al.

[11] 4,451,227

[45] May 29, 1984

[54] FLAME SAFEGUARD SEQUENCER HAVING SWITCH TEST FUNCTIONS

[75] Inventors: William R. Landis, Bloomington; Paul B. Patton, Columbia Heights, both of Minn.

[73] Assignee: Honeywell Inc., Minneapolis, Minn.

[21] Appl. No.: 455,148

[22] Filed: Jan. 3, 1983

[51] Int. Cl.[3] ..... F23N 5/00

[52] U.S. Cl. ..... 431/18; 431/29

[58] Field of Search ..... 431/3, 13, 14, 17, 18, 431/26, 29, 30, 31; 371/62; 364/184, 185, 186

[56] References Cited

U.S. PATENT DOCUMENTS

| | | | |
|---|---|---|---|
| 3,814,569 | 6/1974 | Jacobsz | 431/29 |
| 4,101,258 | 7/1978 | Jacobsz | 431/26 |
| 4,145,179 | 3/1979 | Tanaka et al. | 431/29 |
| 4,196,356 | 4/1980 | Kabat | 307/117 |
| 4,299,556 | 11/1981 | Todo et al. | 431/29 |
| 4,395,224 | 7/1983 | Cade | 431/46 X |
| 4,399,537 | 8/1983 | Jones | 431/24 X |

*Primary Examiner*—Samuel Scott
*Assistant Examiner*—Margaret A. Focarino
*Attorney, Agent, or Firm*—Alfred N. Feldman

[57] ABSTRACT

The high fire and low fire switches normally operated by a damper in a fuel burner installation are verified by a switch test function. In the event that the switches are malfunctioning, the fuel burner sequence is extended to compensate, or the sequence is terminated and annunciated. The extension of the sequence is accomplished by a time sequencer alteration means that is part of a flame safeguard sequencer.

5 Claims, 2 Drawing Figures

FLAME SAFEGUARD SEQUENCER HAVING SWITCH TEST FUNCTIONS

BACKGROUND OF THE INVENTION

Large industrial and commercial fuel burners have, for many years, used flame safeguard sequencers to properly operate the burner equipment. Typically, the flame safeguard sequencer controls a damper by way of a damper motor or actuator, a fan for supplying combustion air, fuel valves for the main burner and pilot, ignition means, and some type of flame detection means. All of this equipment has typically been sequenced for proper burner operation by electromechanical equipment. The most common type of flame safeguard sequencer is an electromechanical device which utilizes cam-driven switches and associated relays to properly sequence all of the burner equipment to provide for a safe start up of the burner, and subsequent burner operation.

In recent years electronic systems have been developed which are capable of providing flame safeguard sequences. These devices typically have been marketed utilizing the same sequence as the electromechanical sequencers that preceded them.

The existing sequencers, whether electromechanical or electronic, typically accept the burner sequence as has been operated in the past and provide little or no additional safety or energy conservation. One area of safety and energy conservation that has been troublesome in the past, and which was not addressed by existing flame safeguard sequencers, is the functioning of a pair of limit switches operated by an air damper to the fuel burner. These switches usually are referred to as the "high fire", and the "low fire" switches. Typically, the "high fire" switch is a switch which indicates, upon its operation, that the damper has reached its full open position thereby allowing for the highest firing rate of the burner. The "low fire" switch typically is a switch which is actuated by the air damper to indicate that the damper is in a minimum position which is used to allow a pilot burner to become ignited and properly stabilized before a larger air flow is introduced into the burner. Many problems have been encountered in actual field installations with the high fire and low fire switches either becoming inoperable or being intentionally jumpered by service personnel to avoid the delay that is built into the flame safeguard sequencers for the time period required for the damper to move from one position to the other. Whether the failure of a high fire or low fire switch is due to a mechanical failure or due to a serviceman jumpering the switch, the malfunction can create an unsafe condition and/or a condition in which energy is wasted in the operation of the fuel burner system.

SUMMARY OF THE INVENTION

The present invention relates to a microcomputer based flame safeguard sequencer for the control of a damper used to supply burner air to a fuel burner. The sequence provided for by the microcomputer can be accomplished by a plug in module to allow for interchange of different types of programs for the system. Whether the novel system function is built into the sequencer, or is provided as a plug-in adaptation is not unique, but has been mentioned to exemplify the actual mode in which the present invention is carried out.

In the operation of the sequence, if the system encounters a closed high fire switch at the time it commands the damper to its high fire position, a faulty switch (or one that is jumpered) is assumed. Additional time, typically 30 seconds, is added to the purge period for the system thereby allowing the damper motor to reach the high fire position. If the system encounters a closed low fire switch when it commands the damper to its low fire position, a faulty switch is again assumed. An additional time delay, again typically 30 seconds, is added at the end of the purge for the damper motor to drive the damper to the low fire position.

In the event that either the low fire switch or the high fire switch fails to close, a safety shut down will be commanded after a set time delay sufficient for the damper motor to drive the damper to the desired position. An energy saving feature is that the burner will be shut down on safety (and normally annunicated) rather than be allowed to operate with the burner air being continuously supplied even though the burner is not functional. Thus, the sequencer provides both safety and energy saving features.

DESCRIPTION OF THE PREFERRED EMBODIMENT

Figure 1:
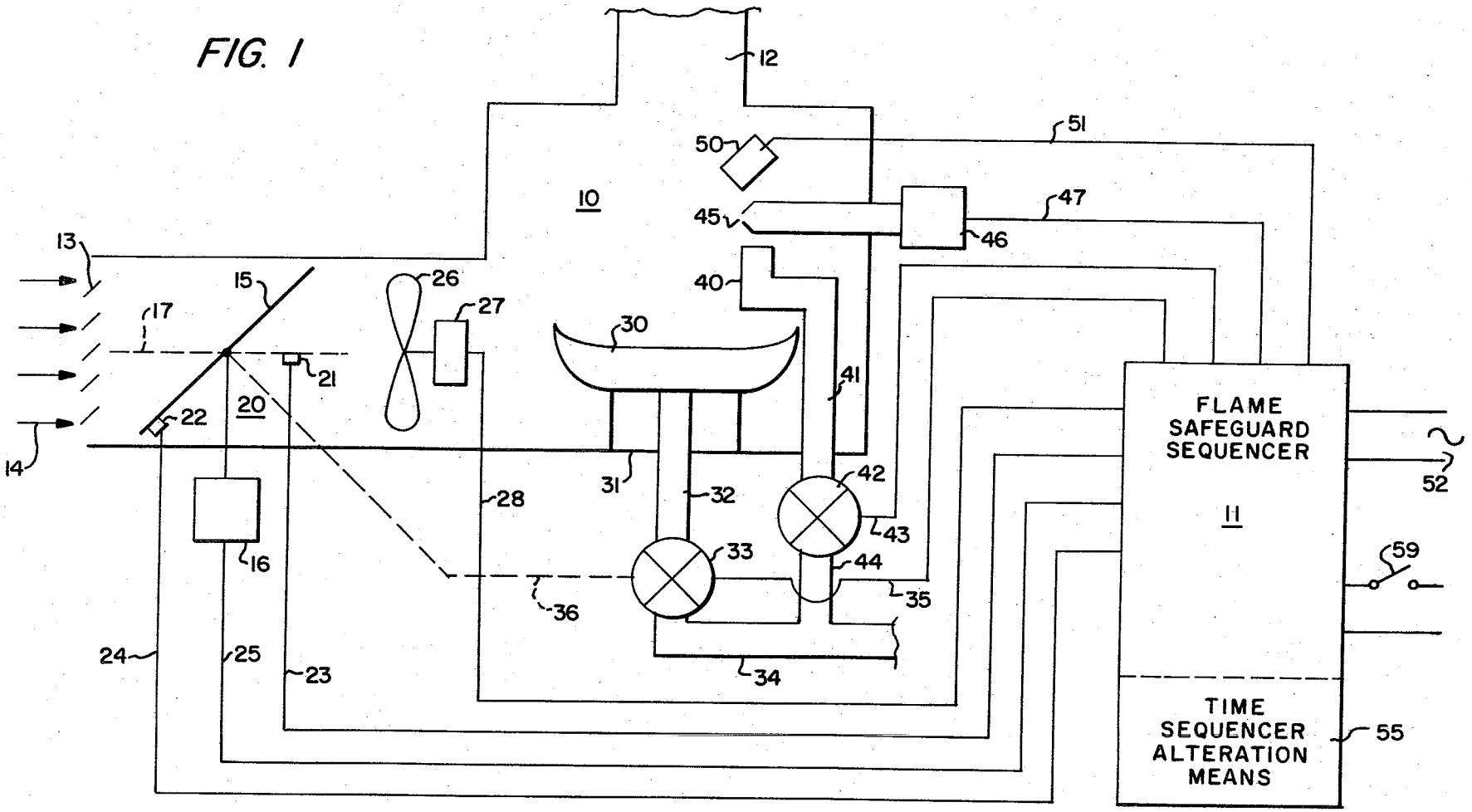
FIG. 1 is a schematic representation of a fuel burner including the novel sequencer.

In FIG. 1 there is schematically disclosed a fuel burner 10 which is operated under the control of a flame safeguard sequencer 11. The fuel burner 10 could be any type of burner such as a gas fired burner, an oil fired burner, or a burner which utilizes both fuels. The flame sequencer 11 typically would operate the fuel burner 10 in any conventional sequence such as example, a prepurge, trial for pilot or trial for ignition, trial for main flame, main flame run or modulation, and a postpurge sequence. The specific type of sequence is not material except that the prepurge portion is operated with the required change in damper positions that will be described in connection with the high and low fire operation contained in the following disclosure. The fuel burner is disclosed as having a stack 12 and an air inlet 13 with air flow schematically indicated at 14. The air inlet 13 is regulated by a damper 15 that is driven by a damper drive motor means 16. The damper 15 is shown in a semiclosed position which will be referred to as a low fire position. A second position disclosed at 17, with the damper open, will be referred to as a high fire position.

A high fire and low fire switch means is disclosed at 20 and includes a pair of switches 21 and 22. The switch 21 is activated by the damper 15 when it reaches the position shown at 17. The switch 22 is activated by the damper 15 in the position shown. Both of the switches 21 and 22 are normally open electrical switches which close to change an electrical state for the flame safeguard sequencer 11 to indicate the proper operation of the damper 15 between the position shown and the position 17. The switch 21 is connected by conductors 23 to the flame safeguard sequencer, while the switch 22 is connected by the conductors 24 to the flame safeguard sequencer 11. The damper drive motor means 16 is connected by conductors 25 to the same flame safeguard sequencer 11 so that the motor means 16 can be operated to drive the damper 15 to in turn properly actuate the switches 21 and 22.

The fuel burner 10 further has a fan or air source 26 driven by a conventional motor 27 that is connected by conductors 28 to the sequencer 11. The fan 26 provides the burner 10 with an air flow 14 from the inlet 13 to the stack 12 to provide combustion air and to provide a prepurge and postpurge operation of the burner, when required.

A burner is schematically disclosed at 30 mounted to the bottom 31 of the fuel burner 10 and supplied by a pipe 32 from a valve 33 connected to a fuel line 34. The valve 33 is connected by electric conductors 35 to the sequencer 11, and also can be connected by a linkage 36 to the damper 15. This is done in order to adjust the flow of fuel through the valve 33 with the position of the damper 15, in addition to controlling the fuel flow through the valve 33 in an off-on manner by electric conductors 35.

A pilot burner 40 is disclosed at the main fuel burner 30 and is connected by a pipe 41 to a pilot fuel valve 42 that has electrical connection means or conductors 43 connected to the sequencer 11. The pilot fuel valve 42 is connected by a pipe 44 to the main fuel pipe 34, as would be used in a gas only installation. The particular type of fuel for the main burner 30 and the pilot burner 40 is not material to the present invention, and the presently disclosed arrangement is purely schematic in nature in order to provide an explanation of an operation of the present invention.

The fuel burner 10 is completed by the provision of an ignition source 45 disclosed as a pair of spark electrodes that are connected to a spark generating means 46 that is connected by conductors 47 to the sequencer 11 to receive power and control. Also provided is a flame sensor means 50 that is connected by conductors 51 to the flame safeguard sequencer 11. The sequencer 11 is energized from a conventional line source at 52, and the fuel burner 10 is initiated by controller 59. The flame safeguard sequencer 11 has a normal sequencing portion and has a further portion 55 that provides a time sequence alteration means for the burner, as will be described after the description of a flow chart of the sequence of operation of the novel portion of the present unit.

Figure 2:
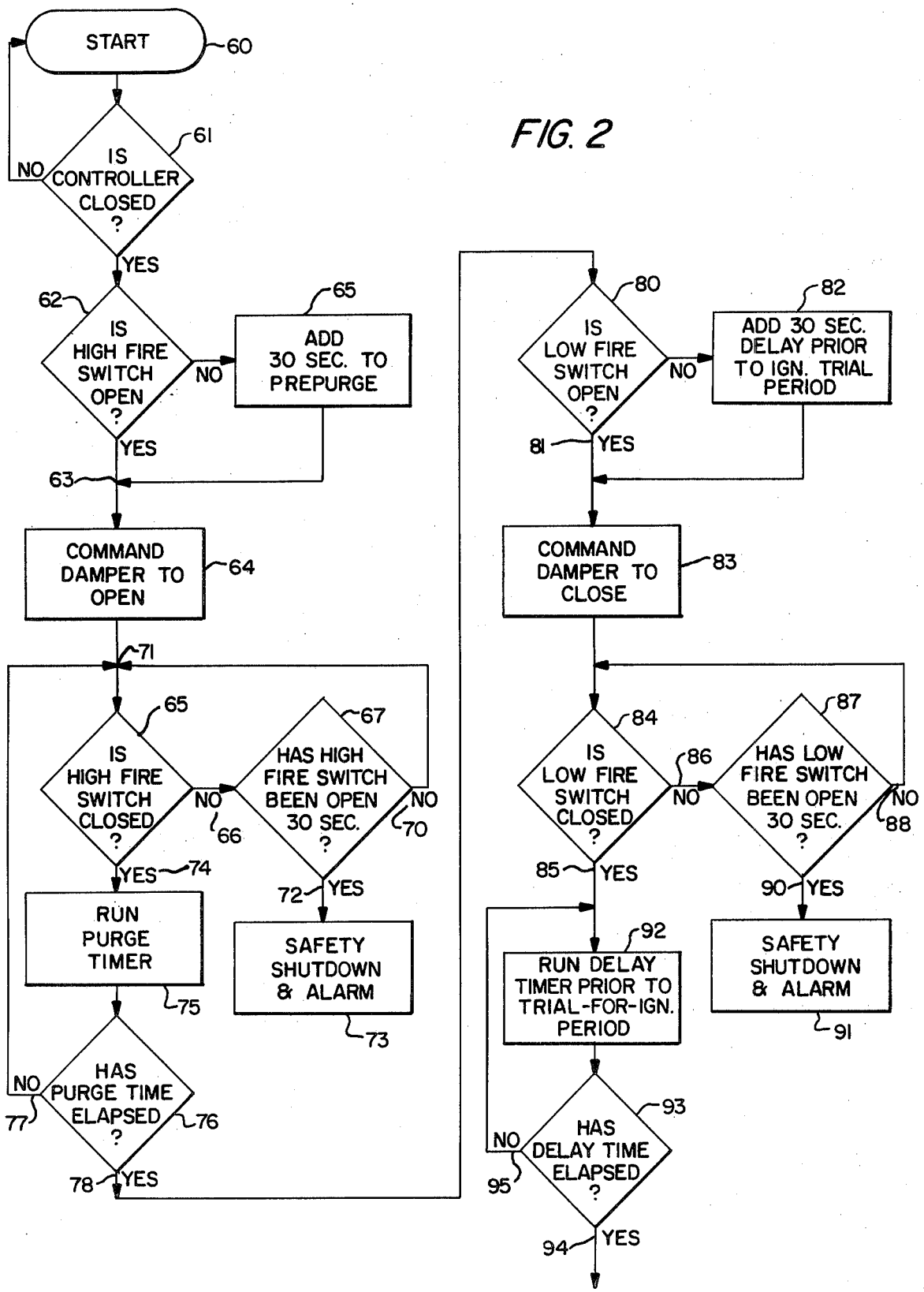
FIG. 2 is a flow chart of the novel portion of operation of the system of FIG. 1.

In FIG. 2 there is disclosed a flow chart of the novel portion of the operation of system of FIG. 1. The flow chart of FIG. 2 basically deals only with the portion of the operation of the system from a start interal to the system reaching a trial for ignition or trial for pilot portion of the sequence. At 60 the sequence is started by the controller 59 for the system being closed. The state or status of the controller is checked at 61 and if the controller is closed the system moves on to 62. At 62 the system determines whether the high fire switch is open. If the switch is open, flow continues through junction 63 and the damper is commanded to open at 64. If the high fire switch is not found to be open at 62 an additional time interval of 30 seconds is added to the prepurge timer at 65. In this way the system is assured of having adequate time to allow the damper to move to the high fire position, as is shown at 17 in FIG. 1.

After the damper is commanded to open at 64 the signal from the high fire switch is tested at 65. If the high fire switch does not close, that is, a "no" output is determined at 66, the system checks at 67 to determine if the high fire switch has been open for at least 30 seconds. This time can be varied to meet the needs of the individual systems. If it has not, the "no" output 70 causes a loop back through junction 71 to 65 where the position of the high fire switch is again checked. The high fire switch closed check 65 is again made and the routine is continued. In the event that the high fire switch has been open for 30 seconds as indicated at function 67, that is when it should be closed, an energy-wasting unsafe condition is detected and the output, at 72 causes a safety shut down and alarm function 73.

If the system is operating normally and the function of the high fire switch being closed at 65 is indicated as a "yes" at 74, this output causes a purge timer 75 to run to time out the desired purge. The function of whether the purge time has elapsed is shown at 76 and if it has not at 77, the loop is closed to recheck that function. If it has occurred at 78, a check is made at 80 as to whether the low fire switch is open. If the low fire switch is open, the cycle continues at 81. If it is not, at 82 an additional 30 seconds is added for damper closure prior to the trial for ignition.

Once the damper closure time has been added at 82, or the low fire switch is determined open at 81, a command to close the damper is provided at 83. This command is necessary to get the damper to the low fire position so that the pilot burner can be lit off after the purge period.

After the damper is commanded to close at 83 it is checked at 84 to determine whether it in fact has closed. If it has closed at 85 a "yes" output is provided and the cycle continues. If a "no" output is provided at 86, a determination is made at 87 whether the low fire switch has been open, for example, for 30 seconds. If it has not been open for 30 seconds as at 88, that portion of the cycle is repeated until the 30 seconds elapses. After the 30 seconds has elapsed a "yes" output 90 is provided and a safety shut down and alarm 91 occurs. This safety shut down and alarm in reality is the same as the safety shut down and alarm function 73 but at a different point in the sequence.

If the sequence is moving normally and the low fire switch is closed at 85, the system continues to run for an appropriate period of time at 92 prior to the trial for ignition period. The time referred to in block 82 is added to timer 92. The delay time period is tested at 93 and if a "yes" output indicating completion of the delay time is provided at 94, the sequence enters the trial for ignition period. If a "no" output is provided at 95, this portion of the cycle is repeated to insure that the proper time has elapsed.

FIG. 2 shows only a portion of a total flow chart for an entire device, that portion including the novel portion of the present invention. The present invention has been disclosed in one embodiment with a particular sequence of operation. The implementation of the monitoring of the high fire and low fire switches and the sequencing can be readily altered for different types of programs and burners, and the present invention is limited in scope solely to the scope of the appended claims.

The embodiments of the invention in which an exclusive property or right is claimed are defined as follows:

1. A flame safeguard sequencer for the control of a damper used to supply a fuel burner with air for purge and combustion with said fuel burner having damper drive motor means, ignition means, fuel supply means and flame sensor means, including: flame safeguard sequencer connected to said damper drive motor means, said ignition means, said fuel supply means and said flame sensor means to sequentially operate said means to properly purge, ignite, and operate said fuel burner in a predetermined timed sequence; high fire and low fire switch means mounted in proximity to said damper and normally actuated by said damper when said drive motor means moves said damper between a low fire position and a high fire position in the sequencing of said burner into normal operation; said switch means normally being open circuited when not actuated by said damper and closed circuited when actuated by said damper to thereby provide said sequencer with a change in electrical state of said switch means upon proper operation of said damper under the control of said sequencer; and said sequencer including time sequencer alteration means to extend said predetermined timed sequence for said damper operation in the event that said switch means is closed circuited when said switch means should be open circuited.

2. A flame safeguard sequencer as described in claim 1 wherein said time sequence alteration means further will terminate the operation of said fuel burner after a set time delay in the event that said switch means fails to close circuit within a predetermined time limit when said damper drive motor means has been energized in accordance to said predetermined timed sequence.

3. A flame safeguard sequencer as described in claim 1 wherein said flame safeguard sequencer includes microcomputer means for providing said sequencer with said predetermined timed sequence; and said microcomputer means further including said time sequencer alteration means for providing said extension of said predetermined time sequence.

4. A flame safeguard sequencer as described in claim 3 wherein said time sequence alteration means further will terminate the operation of said fuel burner after a set time delay in the event that said switch means fails to close circuit when said damper drive motor means has been energized in accordance with said predetermined timed sequence.

5. A flame safeguard sequencer as described in claim 4 wherein said high fire and low fire switch means are a pair of normally open electrical switches.

* * * * *